US007312601B2

(12) United States Patent
Mihara

(10) Patent No.: US 7,312,601 B2
(45) Date of Patent: Dec. 25, 2007

(54) START-UP CIRCUIT FOR A CURRENT GENERATOR

(75) Inventor: Masaaki Mihara, Chuo-ku chiba (JP)

(73) Assignee: STMicroelectronics KK (JP)

( * ) Notice: Subject to any disclaimer, the term of this patent is extended or adjusted under 35 U.S.C. 154(b) by 299 days.

(21) Appl. No.: 10/945,721

(22) Filed: Sep. 21, 2004

(65) Prior Publication Data

US 2006/0061345 A1 Mar. 23, 2006

(51) Int. Cl.
*G05F 3/04* (2006.01)

(52) U.S. Cl. ..... 323/312; 323/901

(58) Field of Classification Search ..... 323/312, 323/315, 901; 327/143, 198, 538, 545
See application file for complete search history.

(56) References Cited

U.S. PATENT DOCUMENTS 6,118,263 A * 9/2000 O'Neill et al. ..... 323/315
6,163,468 A * 12/2000 Barnes ..... 363/49
6,404,252 B1 * 6/2002 Wilsch ..... 327/198
6,528,978 B2 * 3/2003 Lim ..... 323/313
6,879,194 B1 * 4/2005 Caldwell ..... 327/143

* cited by examiner

*Primary Examiner*—Adolf Berhane
(74) *Attorney, Agent, or Firm*—David V. Carlson; Lisa K. Jorgenson

(57) ABSTRACT

A circuit includes a current generator, a start-up circuit coupled to provide a start-up current to the current generator during a start-up phase of the current generator, and a cut-off circuit coupled to both the current generator and to the start-up circuit to provide a control signal that reduces the start-up current when an output current from the current generator exceeds a threshold value.

25 Claims, 3 Drawing Sheets

START-UP CIRCUIT FOR A CURRENT GENERATOR

BACKGROUND OF THE INVENTION

1. Field of the Invention

The present invention relates to electronic circuits, and more particularly, to a start-up circuit for a current generator.

2. Description of the Related Art

Current generators using internal feedback often require some type of start-up circuit to get the current generator started. Start-up circuits are needed because most such current generators have two stable states: one of them being the operating state at which the desired amount of current flows, and the other being a zero-current or off state. When power is first applied to a current generator, it is sometimes necessary to provide a separate input current to move them from the off state towards the correct current flow state. Start-up circuits typically supply a small amount of start-up current to the current generator in order to eliminate the zero-current state so that the current generator can get started and stabilize at the desired operating state.

Typical start-up circuits, however, continue to supply the start-up current to the current generator even after the desired operating state has been achieved. The presence of the start-up current after the current generator has stabilized to the desired operating state can, in many situations, have a detrimental effect on the current generator's performance. This is because the start-up current is now an unwanted element that unnecessarily influences the stable operation of the current generator, and can cause a significant change or variation in the generated currents. This is especially true when the current generator is designed to operate at low current.

FIG. 1 is a circuit diagram of a prior art start-up circuit 10 for a current generator 12. Start-up circuit 10 is coupled to appropriate voltage supply sources Vs and Vss, for example 1.8 volts and ground, respectively, and includes transistors M1, M2 and D1-D3. Transistors D1-D3 are each diode-connected n-channel MOSFETs having a drain, a source and a gate, and each having its gate connected to its drain. Transistor D1 has its source connected to voltage source Vss, transistor D2 has its source connected to the drain of transistor D1, and transistor D3 has its source connected to the drain of transistor D2 and its drain connected to node 325, thus forming a series string of diode-connected MOSFETs having an equivalent resistance from node 325 to Vss.

Transistors M1 and M2 are each p-channel MOSFETs having a source, a drain and a gate. Transistor M2 has its source connected to voltage source Vs, and has its drain connected to node 325, which is also the drain of transistor D3. Transistor M1 has its source connected to voltage source Vs, and has its gate connected to node 325. The drain of transistor M1 is coupled to an input node 13 of the current generator to provide the start-up current to current generator 12.

Current generator 12 includes transistors Q1 and Q2, resistors R2 and R3, and a current mirror consisting of transistors M3 and M4. Transistors M3 and M4 are each p-channel MOSFETs having a source, a drain and a gate. Transistor M4 has its drain connected to its gate, and its gate connected to the gate of transistor M3 forming node 436. The sources of transistors M3 and M4 are connected to voltage source Vs. The gate of transistor M2 is coupled to node 436.

Transistors Q1 and Q2 are each npn bipolar junction transistors having a collector, an emitter and a base, where transistors Q2 and Q1 have a size ratio difference of a desired value, for example, 6:1. Transistor Q1 has its emitter connected to voltage source Vss, and its base connected to the drain of transistor M3. Resistors R2 and R3 are connected in series between the drain of transistor M3 and the collector of transistor Q1. Transistor Q2 has its emitter connected to voltage node Vss, its base connected to the collector of transistor Q1, and its collector connected to the drain of transistor M4. The base of transistor Q2 is connected to the drain of transistor M1 so that the start-up current from start-up circuit 10 is received at the base of transistor Q2.

It is assumed that the voltage at voltage source Vs is initially 0 volts, resulting in no current flowing in the circuit. When the circuit is first powered up and the voltage level rises from zero volts toward a stable Vs, transistors M1-M4 will be turned on, and transistors D1-D3, Q1 and Q2 remain off for a short time. A start-up current Is is provided through transistor M1 to node 13 to start operation of the current generator 12. As the voltage at voltage source Vs continues to increase to 1.8 volts, for example, the voltage across diode-connected transistors D1-D3 also increases. When the voltage at node 325 is high enough to turn on transistors D1-D3, current flows through transistors D1-D3. Current continues to flow through transistor M1, which provides the start-up current Is to current generator 12. The amount of start-up current provided by transistor M1 is controlled by the voltage at node 325, which is determined by the equivalent resistance across diode-connected transistors D1-D3 as compared to M2.

Upon receiving the start-up current Is from transistor M1, transistor Q2 turns on and starts operation of the current generator. The current generator quickly reaches its designed operating state, producing the present output current Io through line 14. The start-up current Is continues to be provided via transistor M1 at a value determined by the combination of the voltage at node 436 and node 325 under the control of transistor M2 and diodes D1-D3.

The start-up current Is, even though it is small, continues to affect operation of the current generator 12. Any noise present on voltage source Vs will affect the amount of current supplied to node 13, thus causing a variation in the output current Io on line 14. The goal of a current generator is to provide a stable, constant current value even if the power supply voltage fluctuates or has noise on the line. The continued application of some value of current to node 13 from the start-up circuit causes unwanted fluctuations and noise in the output current. This has an even greater detrimental effect in very low voltage and low current circuits.

BRIEF SUMMARY OF THE INVENTION

An embodiment of the present invention provides a circuit comprising: a current generator, a start-up circuit coupled to provide a start-up current to the current generator during a start-up phase of the current generator, and a cut-off circuit coupled to both the current generator and to the start-up circuit to provide a control signal that reduces the start-up current when an output current from the current generator exceeds a threshold value.

Another embodiment of the present invention provides a circuit comprising: current generating means for generating an output current, start-up means for providing a start-up current to the current generating means during a start-up phase, and cut-off means for reducing the start-up current when the output current exceeds a threshold value.

Another embodiment of the present invention provides a method of starting a current generator, comprising: providing a start-up current to the current generator during a start-up phase of the current generator, receiving a feedback signal from the current generator as a function of an output current of the current generator, and reducing the start-up current in response to the feedback signal.

Another embodiment of the present invention provides a start-up circuit for a current generator, comprising: first and second power supply nodes for connection to an electrical power supply, a feedback node for receiving a feedback signal from the current generator, an output node for applying a start-up current to the current generator, a first transistor connected to the feedback node for drawing a first current, a second transistor connected to the first transistor for drawing a second current, a current mirror connected to the first and second transistors for regulating the first and second currents and providing a control signal, and a third transistor connected to the current mirror and the output node for drawing the start-up current in response to the control signal.

BRIEF DESCRIPTION OF THE SEVERAL VIEWS OF THE DRAWING(S)

DETAILED DESCRIPTION OF THE INVENTION

Figure 1:
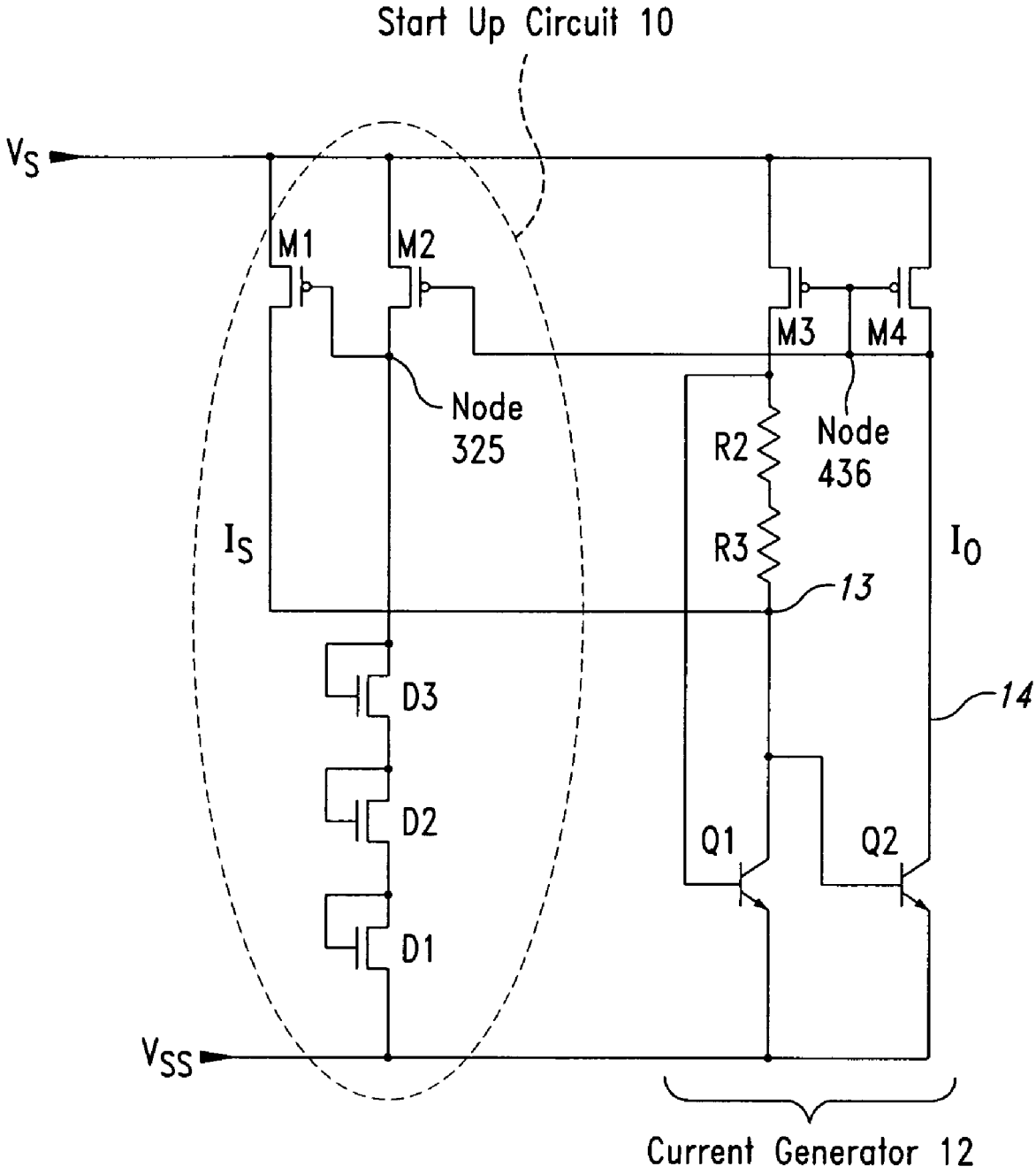
FIG. 1 (Prior Art)
FIG. 1 is a circuit diagram of a prior art start-up circuit.
Figure 2:
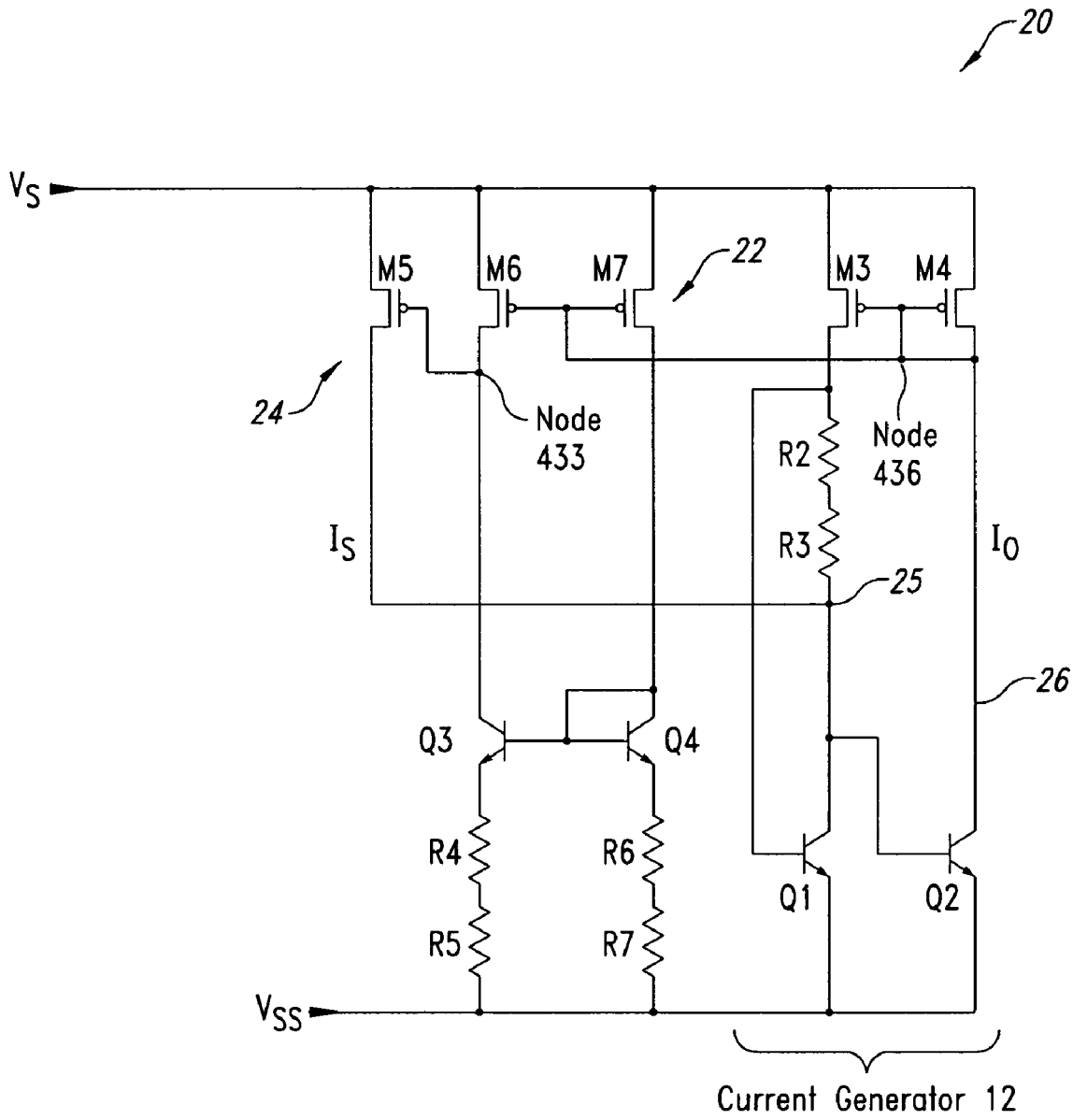
FIG. 2 is a circuit diagram of a first embodiment of a start-up circuit according to the present invention.

FIG. 2 is a circuit diagram of a first embodiment of a circuit 20 according to the present invention. The circuit 20 includes a current generator 12 similar to that in FIG. 1 and also a cut-off circuit 22 and a start-up circuit 24. Circuit 20 is coupled to appropriate voltage sources Vs and Vss, for example 1.8 volts and ground, respectively, and includes resistors R2-R7, transistors M3-M7, a current mirror consisting of transistors Q1 and Q2, and a current mirror consisting of transistors Q3 and Q4. Transistors Q3 and Q4 are each npn bipolar junction transistors having a collector, an emitter and a base, where transistors Q4 and Q3 have a selected size ratio, for example 2:1, 3:1 or some other value. Transistor Q4 has its collector connected to its base, and its base connected to the base of transistor Q3. Resistors R4 and R5 are connected in series between the emitter of transistor Q3 and voltage source Vss, and resistors R6 and R7 are connected in series between the emitter of transistor Q4 and voltage source Vss. Resistors R4 and R6 have a selected resistance ratio, for example 2:1, 3:1 or some other value. Resistors R5 and R7 have a similar resistance ratio.

Transistors M5-M7 are each p-channel MOSFETs having a source, a drain and a gate. Transistor M7 has its source connected to voltage source Vs, its drain connected to the collector of transistor Q4, and its gate connected to node 436. Transistor M6 has its source connected to voltage source Vs, its gate connected to the gate of transistor M7, and its drain connected to node 433, which is also the collector of transistor Q3. Transistor M5 has its source connected to voltage source Vs, and its gate connected to node 433. The drain of transistor M5 is coupled to input node 25 of the current generator to provide the start-up current to current generator 12.

It is assumed that the voltage at voltage source Vs is initially 0 volts, resulting in no current flowing in the circuit. When the circuit is first powered up and the voltage level rises from zero volts toward a stable Vs, transistors M3-M7 will be turned on, and transistors Q1-Q4 remain off for a short time. A start-up current Is is provided through transistor M5 to node 25 to start operation of the current generator 12. If necessary, to turn on transistors Q3 and Q4 and start operation of cut-off circuit 22, current can be injected into the base of transistor Q4. For example, cross-coupled NAND gates can be used to provide a one-shot into the base of transistor Q4.

Upon receiving the start-up current Is from transistor M5, transistor Q2 turns on and starts operation of the current generator. The current generator quickly reaches its designed operating state, producing the present output current Io through line 26. Because transistor M4 is turned on and connected as a diode, the voltage at node 436 is held at a diode-drop below voltage source Vs. The gates of transistors M6 and M7 are connected to node 436, and as a result, the voltage at node 436 ensures that transistors M6 and M7 remain on. In this way, node 436 provides a feedback signal to cut-off circuit 22.

The current mirror consisting of transistors Q3 and Q4 controls the current flow through transistors M6 and M7. In this particular example, transistors Q4 and Q3 have a size ratio of 2:1. As a result, transistor Q4 will draw twice as much current as transistor Q3. All that remains to determine the voltage at node 433 is the resistance values of resistors R4-R7. In this particular example, the resistance of resistors R4 and R5 is twice the resistance of resistors R6 and R7. This creates a high voltage at node 433 that approaches voltage source Vs. Because the gate of transistor M5 is connected to node 433, the voltage at node 433 controls the start-up current Is drawn by transistor M5. In this way, node 433 provides a control signal to start-up circuit 24.

As the voltage at node 433 approaches voltage source Vs, the voltage between the source and the gate of transistor M5 becomes less than the threshold voltage of the p-channel MOSFET, thus turning off transistor M5. As a result, the start-up current Is drawn by transistor M5 is reduced to approximately zero. Therefore, the start-up current Is will no longer affect the operation of current generator 12.

Figure 3:
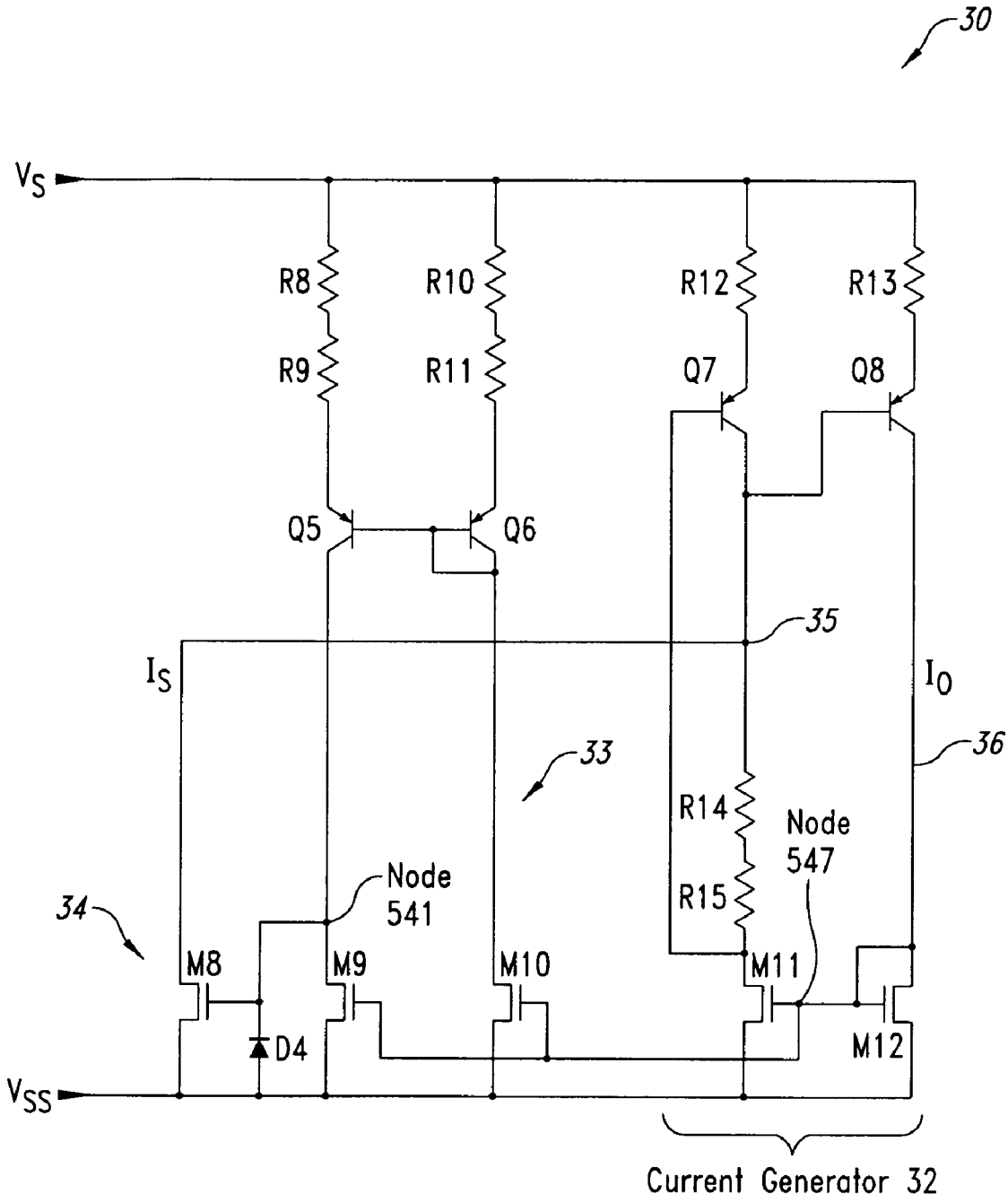
FIG. 3 is a circuit diagram of a second embodiment of a start-up circuit according to the present invention.

FIG. 3 is a circuit diagram of a second embodiment of a circuit 30 according to the present invention. Circuit 30 is a high voltage version of circuit 20 and is coupled to an input voltage of approximately 20 to 100 volts, preferably 60 volts. Circuit 30 operates on the same basic principles as circuit 20, except circuit 30 utilizes pnp bipolar junction transistors and n-channel MOSFETs.

Circuit 30 includes a current generator 32, a cut-off circuit 33 and a start-up circuit 34. Circuit 30 is coupled to appropriate voltage sources Vs and Vss, for example 60 volts and ground, respectively, and includes resistors R8-R15, transistors M8-M12, diode D4, a current mirror consisting of transistors Q5 and Q6, and a current mirror consisting of transistors Q7 and Q8. Transistors Q5 and Q6 are each pnp bipolar junction transistors having an emitter, a collector and a base, where transistors Q6 and Q5 have a selected size ratio, for example 2:1, 3:1 or some other value. Transistor Q6 has its collector connected to its base, and its base connected to the base of transistor Q5. Resistors R10 and R11 are connected in series between the emitter of transistor Q6 and voltage source Vs, and resistors R8 and R9 are connected in series between the emitter of transistor Q5 and voltage source Vs. Resistors R8 and R10 have a selected resistance ratio, for example 2:1, 3:1 or some other value. Resistors R9 and R11 have a similar resistance ratio.

Transistors M8-M12 are each n-channel MOSFETs having a drain, a source and a gate. Transistor M10 has its source connected to voltage source Vss, its drain connected to the collector of transistor Q6, and its gate connected to the gate of transistor M9. Transistor M9 has its source connected to voltage source Vss, and its drain connected to node 541, which is also the collector of transistor Q5. Transistor M8 has its source connected voltage source Vss, and its gate connected to node 541. Diode D1 has its anode connected to voltage source Vss, and its cathode connected to the gate of transistor M8. The drain of transistor M8 is coupled to an input node 35 of the current generator to draw the start-up current from current generator 32.

Current generator 32 includes transistors Q7 and Q8, resistors R12-R15, and a current mirror consisting of transistors M11 and M12. Transistor M12 has its drain connected to its gate, and its gate connected to the gate of transistor M11 forming node 547. The sources of transistors M11 and M12 are connected to voltage source Vss. The gate of transistor M10 is coupled to node 547.

Transistors Q8 and Q7 have a size ratio difference of a desired value, for example, 6:1. Transistor Q7 has its base connected to the drain of transistor M11. Resistor R12 is connected between the emitter of transistor Q7 and voltage source Vs, and resistors R14 and R15 are connected in series between the collector of transistor Q7 and the drain of transistor M11. Transistor Q8 has its collector connected to the drain of transistor M12, and its base connected to the collector of transistor Q7. Resistor R13 is connected between the emitter of transistor Q8 and voltage source Vs. The base of transistor Q8 is connected to the drain of transistor M8 so that the start-up current is drawn by start-up circuit 34 from the base of transistor Q8.

It is assumed that the voltage at voltage source Vs is initially 0 volts, resulting in no current flowing in the circuit. When the circuit is first powered up and the voltage level rises from zero volts toward a stable Vs, transistors M8-M12 will be turned on, and transistors Q5-Q8 remain off for a short time. A start-up current Is is drawn by transistor M8 from node 35 to start operation of the current generator 32. If necessary, to turn on transistors Q5 and Q6 and start operation of cut-off circuit 33, current can be drawn from the base of transistor Q6.

Upon the start-up current Is being drawn by transistor M8, transistor Q8 turns on and starts operation of the current generator. The current generator quickly reaches its designed operating state, producing the present output current Io through line 36. Because transistor M12 is turned on and connected as a diode, the voltage at node 547 is held at a diode-drop above voltage source Vs. The gates of transistors M9 and M10 are connected to node 547, and as a result, the voltage at node 547 ensures that transistors M9 and M11 remain on. In this way, node 547 provides a feedback signal to cut-off circuit 33.

The current mirror consisting of transistors Q5 and Q6 controls the current flow through transistors M9 and M1. In this particular example, transistors Q6 and Q5 have a size ratio of 2:1. As a result, transistor Q6 will draw twice as much current as transistor Q5. All that remains to determine the voltage at node 541 is the resistance values of resistors R8-R11. In this particular example, the resistance of resistors R8 and R9 is twice the resistance of resistors R10 and R11. This creates a low voltage at node 541 that approaches voltage source Vss. Because the gate of transistor MB is connected to node 541, the voltage at node 541 controls the start-up current Is drawn by transistor M8. In this way, node 541 provides a control signal to start-up circuit 34.

As the voltage at node 541 approaches voltage source Vss, the voltage between the gate and the source of transistor M8 becomes less than the threshold voltage of the n-channel MOSFET, thus turning off transistor M8. As a result, the start-up current Is drawn by transistor M8 is reduced to approximately zero. Therefore, the start-up current Is will no longer affect the operation of current generator 32.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A circuit comprising:

a current generator having;

an input node;

a start-up circuit coupled to provide a start-up current to the input node of the current generator during a start-up phase of the current generator;

a feedback node coupled to provide a feedback signal as a function of an output current of the current generator; and a cut-off circuit coupled to both the current generator and the start-up circuit to provide a control signal that reduces the start-up current when the output current from the current generator exceed a threshold value, the cut-off circuit including a current mirror that outputs the control signal to the start-up circuit, coupled to the feedback node.

2. The circuit of claim 1 wherein the current generator comprises:

a first transistor coupled to the input node to control the output current.

3. The circuit of claim 1 wherein the current mirror controls the control signal as a function of the output current.

4. The circuit of claim 2 wherein the cut-off circuit comprises:

an input node coupled to receive the feedback signal from the current generator;

a first cut-off transistor coupled to the input node of the cut-off circuit to control a first cut-off circuit current; and a control node providing the control signal as a function of the first cut-off circuit current.

5. The circuit of claim 4 wherein the cut-off circuit further comprises:

a second cut-off transistor coupled to the input node of the cut-off circuit, to control a second cut-off circuit current;

the current mirror coupled to the first and second cut-off transistors and to the control node.

6. The circuit of claim 5 wherein the current mirror controls the control signal as a function of the first cut-off circuit current.

7. The circuit of claim 4 wherein the start-up circuit comprises:

an input node receiving the control signal from the cut-off circuit; and a first start-up transistor coupled to the input node of the start-up circuit to control the start-up current.

8. The circuit of claim 7 wherein the control signal causes the first transistor to reduce the start-up current to approximately zero.

9. The circuit of claim 1 wherein the current mittor comprises first and second cut-off circuit providing the signal as a function of the first cut-off circuit current.

10. A circuit comprising:

current generating means for generating an output current;

start-up means for providing a start-up current to the current generating means during a start-up phase; and a cut-off circuit configured to reduce the staff-up current when the output current exceeds a threshold value, including:

a feedback node coupled to receive a feedback signal from the current generating means as a function of the output current, first and second transistors coupled to the feedback node, a cut-off current mirror configured to control current flowing in the first arid second transistors and outputting a control signal at a control node to reduce the current output by the start-up means.

11. The circuit of claim 10 wherein the cut-off circuit provides the control signal to the start-up means as a function of the feedback signal.

12. The circuit of claim 11 wherein the start-up means reduces the staff-up current as a function of the control signal.

13. The circuit of claim 12 wherein the start-up means reduces the staff-up current to approximately zero.

14. A method of starting a current generator, comprising:

outputting start-up current to the current generator during a start-up phase of the current generator;

receiving a feedback signal from the current generator as a function of an output current of the current generator;

producing a cut-off current and a corresponding mirror current as a function of the feedback signal:

producing a control signal as a function of the mirror current; and reducing the staff-up current in response to the control signal.

15. The method of claim 14 wherein the feedback signal indicates the output current has exceeded a threshold value.

16. The method of claim 14 wherein reducing the start-up current comprises:

reducing the start-up current to approximately zero.

17. A start-up circuit for a current generator, comprising:

first and second power supply nodes for connection to an electrical power supply;

a feedback node for receiving a feedback signal from the current generator;

an output node for applying a start-up current to the current generator;

a first transistor connected to the feedback node for drawing a first current;

a second transistor connected to the first transistor for drawing a second current;

a current mirror connected to the first and second transistors for regulating the first and second currents and providing a control signal; and a third transistor connected to the current mirror and the output node for drawing the start-up current in response to the control signal.

18. The start-up circuit of claim 17 wherein the current mirror comprises:

a fourth transistor connected to the first transistor; and a fifth transistor connected to the second transistor and the fourth transistor.

19. The start-up circuit of claim 18 wherein the first, second and third transistors are each p-channel MOSFETs having a source, a drain and a gate; the first transistor having its source connected to the first power supply node, and its gate connected to the feedback node and the gate of the second transistor; the second transistor having its source connected to the first power supply node; and the third transistor having its source connected to the first power supply node, and its drain connected to the output node.

20. The start-up circuit of claim 19 wherein the fourth and fifth transistors are each npn bipolar junction transistors having a collector, an emitter and a base; the fourth transistor having its collector connected to its base and the drain of the first transistor, and its base connected to the base of the fifth transistor; and the fifth transistor having its collector connected to the drain of the second transistor and to the gate of the third transistor.

21. The staff-up circuit of claim 20, further comprising:

a first resistor connected between the emitter of the fourth transistor and the second power supply node; and a second resistor connected between the emitter of the fifth transistor and the second power supply node.

22. The start-up circuit of claim 18 wherein the first, second and third transistors are each n-channel MOSFETs having a drain, a source and a gate; the first transistor having its source connected to the second power supply node, and its gate connected to the feedback node and the gate of the second transistor; the second transistor having its source connected to the second power supply node; and the third transistor having its source connected to the second power supply node, and its drain connected to the output node.

23. The start-up circuit of claim 22 wherein the fourth and fifth transistors are each pnp bipolar junction transistors having an emitter, a collector and a base; the fourth transistor having its collector connected to its base and the drain of the first transistor, and its base connected to the base of the fifth transistor; and the fifth transistor having its collector connected to the drain of the second transistor and to the gate of the third transistor.

24. The staff-up circuit of claim 23, farther comprising:

a diode connected between the gate of the third transistor and the second power supply node;

a first resistor connected between the first power supply node and the emitter of the fourth transistor; and a second resistor connected between the first power supply node and the emitter of the fifth transistor.

25. The start-up circuit of claim 18 wherein the fourth and fifth transistors have a size ratio of 2:1.

* * * * *

UNITED STATES PATENT AND TRADEMARK OFFICE

CERTIFICATE OF CORRECTION

PATENT NO. : 7,312,601 B2
APPLICATION NO. : 10/945721
DATED : December 25, 2007
INVENTOR(S) : Masaaki Mihara It is certified that error appears in the above-identified patent and that said Letters Patent is hereby corrected as shown below:

Column 6

Line 24, "a current generator having;" should read as -- a current generator having: --

Line 34, "from the current generator exceed a threshold value, the" should read as -- from the current generator exceeds a threshold value, the --

Lines 56-60, "a second cut-off transistor coupled to the input node of the cut-off circuit, to control a second cut-off circuit current; the current mirror coupled to the first and second cut-off transistors and to the control node." should read as -- a second cut-off transistor coupled to the input node of the cut-off circuit, to control a second cut-off circuit current, the current mirror coupled to the first and second cut-off transistors and to the control node. --

Column 7

Line 4, "the first transistor to reduce the start-up current to" should read as -- the first start-up transistor to reduce the start-up current to --

Lines 6-8, "wherein the current mittor comprises first and second cut-off circuit providing the signal as a function of the first cut-off circuit current." should read as -- wherein the current mirror comprises first and second cut-off circuit currents, the cut-off circuit providing the control signal as a function of the first cut-off circuit current. --

Line 13, "a cut-off circuit configured to reduce the staff-up current" should read as -- a cut-off circuit configured to reduce the start-up current --

Line 20, "node," should read as -- node, and --

Lines 21-24, "a cut-off current mirror configured to control current flowing in the first arid second transistors and outputting a control signal at a control node to reduce the current output by the start-up means" should read as -- a cut-off current mirror configured to control current flowing in the first and second transistors and outputting a control signal at a control node to reduce the output current by the start-up means --

Line 29, "reduces the staff-up current as a function of the control" should read as -- reduces the start-up current as a function of the control --

UNITED STATES PATENT AND TRADEMARK OFFICE

CERTIFICATE OF CORRECTION

PATENT NO. : 7,312,601 B2
APPLICATION NO. : 10/945721
DATED : December 25, 2007
INVENTOR(S) : Masaaki Mihara It is certified that error appears in the above-identified patent and that said Letters Patent is hereby corrected as shown below:

Column 7

Line 32, "reduces the staff-up current to approximately zero." should read as -- reduces the start-up current to approximately zero. --

Line 34, "outputting start-up current to the current generator during" should read as -- outputting a start-up current to the current generator during --

Line 42, "reducing the staff-up current in response to the control" should read as -- reducing the start-up current in response to the control --

Column 8

Line 28, "The staff-up circuit of claim 20, further comprising:" should read as -- The start-up circuit of claim 20, further comprising: --

Line 51, "The staff-up circuit of claim 23, farther comprising:" should read as -- The start-up circuit of claim 23, further comprising: --

Signed and Sealed this

Eleventh Day of August, 2009

David J. Kappos

David J. Kappos
*Director of the United States Patent and Trademark Office*